US006205971B1

(12) United States Patent
Inumaru et al.

(10) Patent No.: US 6,205,971 B1
(45) Date of Patent: Mar. 27, 2001

(54) CRANKSHAFT ROTATION STRUCTURE FOR FOUR CYCLE ENGINE

(75) Inventors: Nobuaki Inumaru; Kouichi Tsutsumi; Yasuo Shimura; Osamu Kudou, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/393,190

(22) Filed: Sep. 10, 1999

(30) Foreign Application Priority Data

Sep. 12, 1998 (JP) ..... 10-276592

(51) Int. Cl.[7] ..... F01M 1/00
(52) U.S. Cl. ..... 123/196 R
(58) Field of Search ..... 123/196 AB, 196 R, 123/41.35; 184/6.5, 6.8

(56) References Cited

U.S. PATENT DOCUMENTS 5,092,292 * 3/1992 Iguchi et al. ..... 123/196 R
5,533,472 * 7/1996 Sands et al. ..... 123/41.35
5,915,350 * 6/1999 Suzuki et al. ..... 123/196 R

FOREIGN PATENT DOCUMENTS 2-2629936 4/1918 (JP) .

* cited by examiner

*Primary Examiner*—Noah P. Kamen
*Assistant Examiner*—Hyder Ali
(74) *Attorney, Agent, or Firm*—Birch, Stewart, Kolasch & Birch, LLP

(57) ABSTRACT

A crankshaft rotation structure for a four cycle engine has a radial ball bearing fitted into a first main bearing section of a crankcase and a radial roller bearing fitted into a second main bearing section of the crankcase. The crankshaft is rotatably supported by the radial ball bearing and radial roller bearing. Furthermore, an oil jet nozzle for cooling a piston is provided in the second main bearing section. The diameter of the shafts for attachment of the bearings can be made the same, even if the outer diameter of the radial roller bearing is decreased compared to the outer diameter of the radial ball bearing. Accordingly, even if the oil jet nozzle is provided in the second main bearing section into which the radial roller bearing is fitted, the distance from the crankshaft center to the attachment position of the oil jet can be decreased and the engine itself can be reduced in size.

12 Claims, 5 Drawing Sheets

CRANKSHAFT ROTATION STRUCTURE FOR FOUR CYCLE ENGINE

BACKGROUND OF THE INVENTION

1. Field of the Invention

The present invention relates to an improvement to a crankshaft rotation structure for a four cycle engine.

2. Description of Related Art

Referring to Japanese Patent Publication No. 2629936, FIG. 10 discloses, a cylinder a, a crankcase d, a sidewall e of the crankcase d, a crankshaft bearing i provided in the sidewall e, and an oil jet h provided in an upper part of the crankshaft bearing i of the side wall e for cooling a piston b.

The above described crank shaft bearing i is a single row bearing. Furthermore, the bearing has a large outer diameter. As a result, the attachment position of an oil jet h provided outside of the crankshaft bearing i becomes greatly separated from the crankshaft center. The piston b should be separated from the crankshaft center so that when the piston b is at a bottom dead center position, it does not interfere with the oil jet h. Accordingly, it is necessary to raise the piston to avoid the oil jet h. As a result, since the distance from the crankshaft center to a cylinder head attached to the cylinder a is increased, the size of the engine must be increased.

SUMMARY OF THE INVENTION

An object of the present invention is therefore to provide a crankshaft rotation structure for a four cycle engine, wherein even if an oil jet is present, it is possible to reduce the distance from the crankshaft center to an attachment position of the oil jet. Accordingly, the size of the engine can be reduced.

In order to achieve the above described object, the present invention includes a crankshaft rotation structure for a four cycle engine having a radial ball bearing fitted into a first main bearing section of a crankcase, a radial roller bearing fitted into a second main bearing section of the crankcase, a crankshaft being rotatably supported by the radial ball bearing and the radial roller bearing. Furthermore, an oil jet nozzle for cooling a piston of the four cycle engine is provided in the second main bearing section.

The load bearing ability of the radial roller bearing is higher than that of the radial ball bearing. Accordingly, when the diameters of the shafts on which the bearings are mounted are the same, the outer diameter of the radial roller bearing can be made smaller than the outer diameter of the radial ball bearing. Accordingly, even if an oil jet nozzle is provided in the second main bearing section where the radial roller bearing is fitted it is possible to reduce the distance from the crank shaft center to an attachment position of the oil jet on the second main bearing section. Therefore, the size of the engine can be reduced.

According to another aspect of the present invention, a main oil passage for supplying oil to the oil jet nozzle, and a secondary oil passage branching off from the main oil passage and leading to the radial roller bearing is provided in the second main bearing section.

It is possible to supply oil from the secondary oil passage to the radial roller bearing. Therefore, the durability of the radial roller bearing can be improved, and the lifespan of the bearing can be prolonged.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
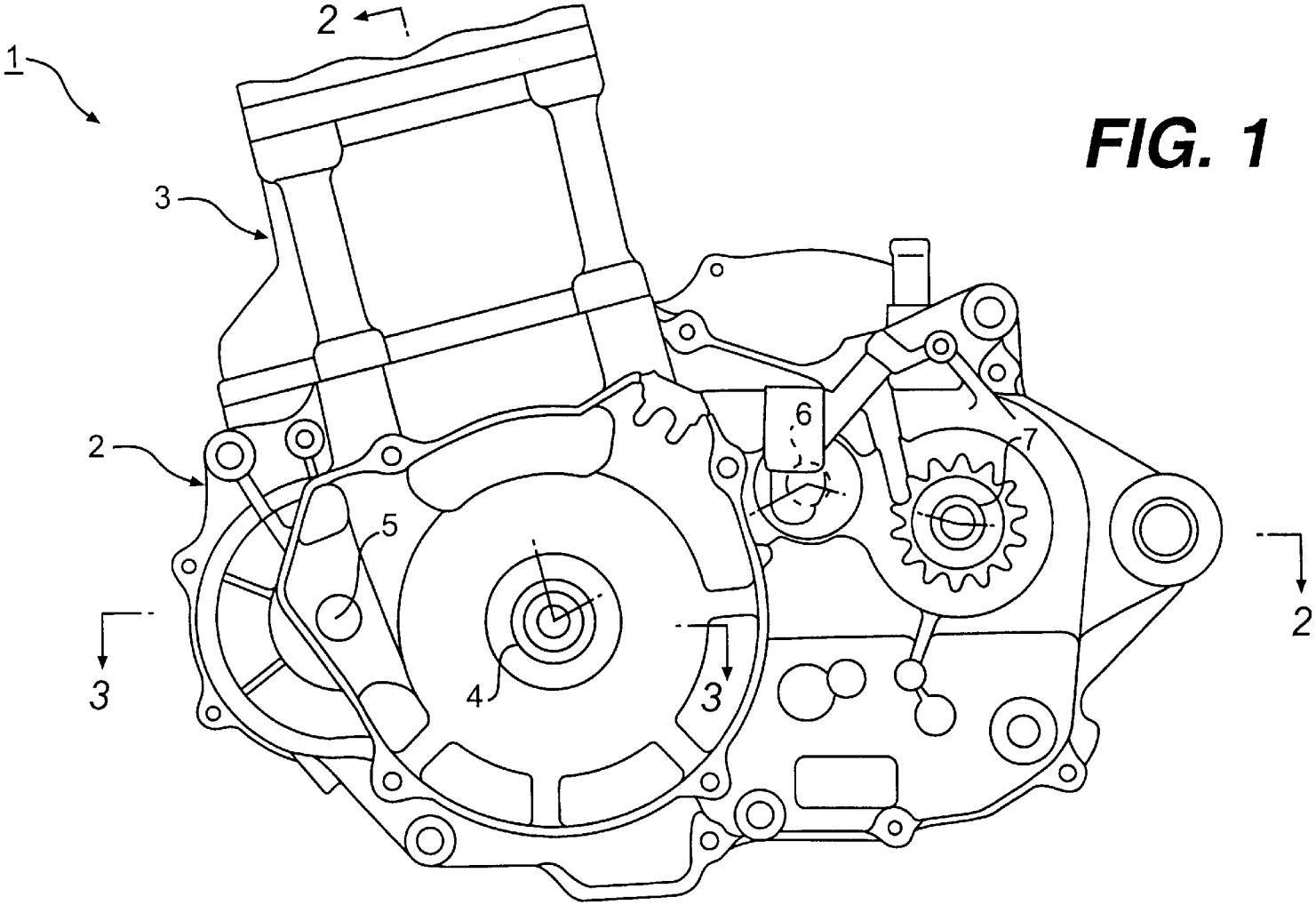
FIG. 1 is a side view of an engine adopting the crankshaft rotation structure of the present invention.

The present invention will now be described with reference to the attached drawings. The drawings should be viewed in the direction of the reference numerals.

FIG. 1 is a side view of an engine adopting the crankshaft rotation structure for the four cycle engine of the present invention. In order to sinplify the description, an AC generator attached to an end part of the crankshaft, a cover of the AC generator and a side cover of the transmission are omitted from the drawings.

An engine 1 is provided with a crankcase section 2 and a cylinder block 3. The crankcase section 2 houses a crankshaft 4, a balancer shaft 5 arranged in front of the crankshaft 4, a main shaft 6 arranged to the side of a transmission behind the crankshaft 4 and a counter shaft 7. The crankshaft 4, balancer shaft 5, main shaft 6 and counter shaft 7 are mounted in the crankcase section 2 for rotation.

Figure 2:
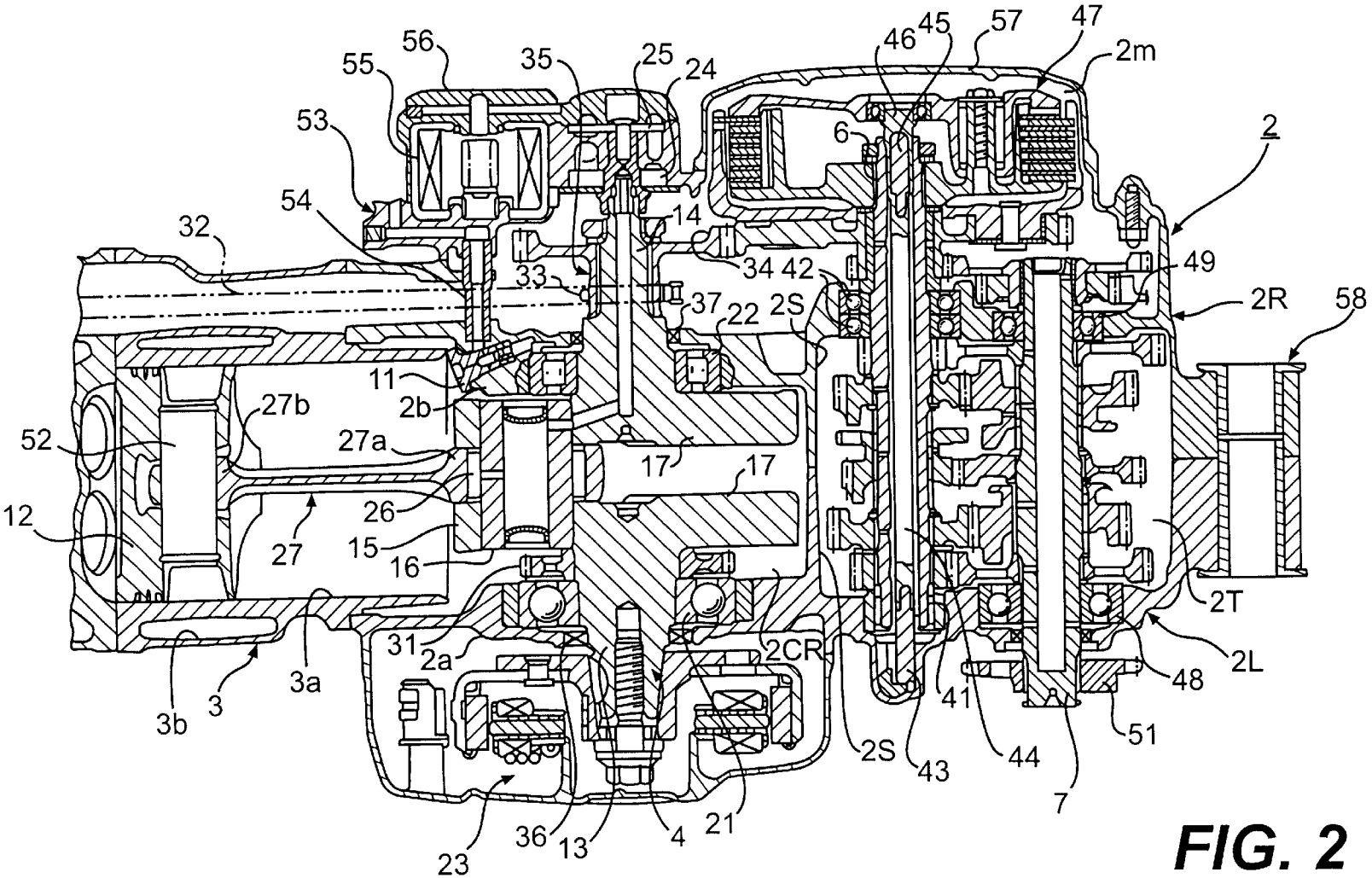
FIG. 2 is a cross sectional view along line 2—2 in FIG. 1.

FIG. 2 is a cross sectional view taken along line 2—2 of FIG. 1. The crankcase section 2 is formed by combining a crankcase 2L and a crankcase 2R, and is divided into a sealed crank chamber 2CR and a transmission chamber 2T by bulkheads 2S, 2S.

The crankcase 2L is provided with a first main bearing section 2*a* for attachment of the crankshaft 4 while the crankcase 2R is provided with a second main bearing section 2*b* for attachment of the crankshaft 4. An oil jet nozzle for cooling a piston, which will be described later, is attached to the side of a cylinder block 3 of this second main bearing section 2*b*.

The cylinder block 3 has a piston 12 inserted into the cylinder section 3*a* so as to be movable. A water-cooling function is performed by coolant water flow in a water jacket 3*b*.

The crankshaft 4 is comprised of first and second shaft sections 13 and 14, a crank section 15 connecting these first and second shafts sections 13 and 14, a crank pin 16 attached to the crank section 15, and counter weights 17, 17 provided on the first and second shaft sections 13 and 14 at sides opposite to the crank section 15 relative to the axial centers of the first and second shafts sections 13 and 14.

The crankshaft 4 is rotatably attached to the crankcase 2L via a radial ball bearing 21, and to the crankcase 2R via a radial roller bearing 22. An AC generator 23 for generating electricity is attached to one end of the crankshaft 4, and a first oil pump 24 and second oil pump 25 for dry sump lubrication are attached to the other end. A big end 27*a* of a connecting rod 27 is rotatably attached to a crank pin 16 via a bearing 26, a balancer shaft drive gear 31 for driving the balancer shaft 5, not shown, is interlocked with the first shaft section 13. A gear member 35 provided with a cam shaft drive gear 33 for driving a cam shaft, not shown, via a chain 32 and a main shaft drive gear 34 for driving a transmission side main shaft 6 is attached to the second shaft section 14. Reference numerals 36 and 37 represent oil seals for preventing leakage of oil from the crank chamber 2CR.

The main shaft 6 is rotatably attached to the crankcase 2L via a bearing 41 and to the crankcase 2R via bearings 42 and 42. A first rod 43, second rod 44, third rod 45 and fourth rod 46 are housed inside the main shaft so as to be movable in the axial direction. A clutch 47 is spline fitted to an outer circumference of an end part of the main shaft 6, and a number of drive gears are spline fitted on the outer circumference and attached so as to be movable in the axial direction.

Because the first rod 43, second rod 44, third rod 45 and fourth rod 46 move in the axial direction, transmission of driving force from the crankshaft 4 to the main shaft 6 is controlled by causing the clutch 47 to be engaged and disengaged.

The counter shaft 7 is rotatably attached to the crankcase 2L via a bearing 48 and to the crankcase 2R via a bearing 49. A plurality of driven gears for meshing with the drive gears of the main shaft 6 are spline fitted on an outer circumference of the counter shaft 7 and attached so as to be movable in the axial direction, and a drive sprocket 51 for driving a not shown wheel via a chain, also not shown, is attached to the end of the counter shaft 7.

The piston 12 is rotatably attached to a small end 27*b* of the connecting rod 27 via a piston pin 52.

In the drawings, reference numeral 53 is a case side cover attached to the side of the crankcase 2R, reference numeral 54 is a connecting pipe for connecting the case side cover 53 and the second main bearing section 2*b* of the crankcase 2R, reference numeral 55 is an oil filter, reference numeral 56 is an oil filter cover, reference numeral 57 is a cover for covering the outer side of the clutch 47, and reference numeral 58 is an attachment section for attaching the engine 1 (refer to FIG. 1) to a vehicle frame, not shown.

Figure 3:
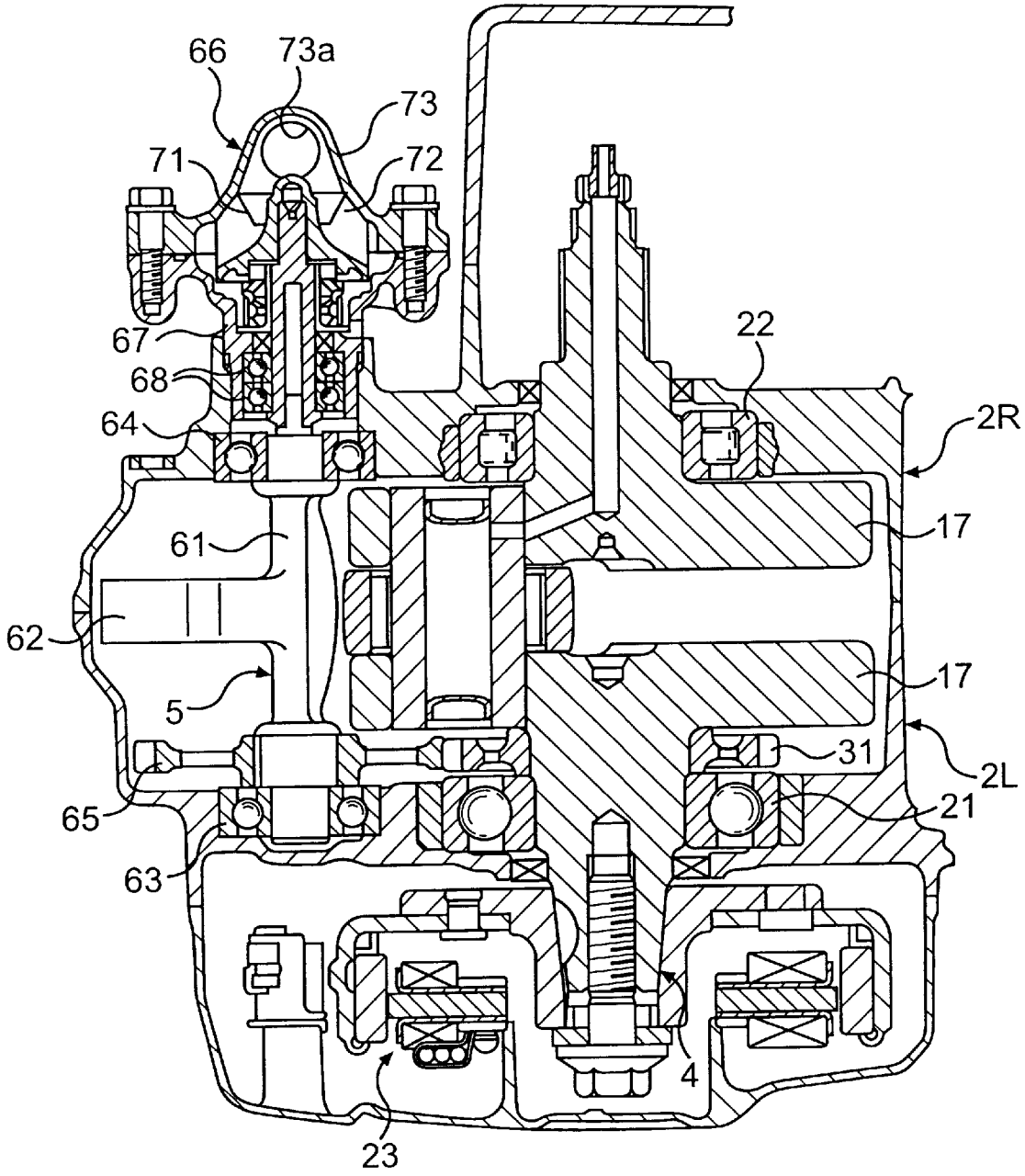
FIG. 3 is a cross sectional view along line 3—3 in FIG. 1.

FIG. 3 is a cross sectional view taken along line 3—3 in FIG. 1. The balancer shaft 5 is comprised of a shaft section 61 and a weight 62 provided in the center of the shaft section 61, and controls engine vibration by rotating at the same speed as the crankshaft 4 and in the opposite direction. The balancer shaft 5 is rotatably attached to the crankcase 2L via bearing 63, and to the crankcase 2R via bearing 64. A driven gear 65 for meshing with a balance drive gear 31 fitted onto the crankshaft 4 is fitted onto the shaft section 61, and a water pump 66 for causing coolant water to circulate is connected to the end of the balancer shaft 5 supported by the bearing 64.

The water pump 66 is comprised of a base section 67 attached to a side surface of the crankcase 2R, a rotation shaft 71 rotatably attached to the base section 67 via bearings 68 and 68 and connected to the balancer shaft 5, an lo impeller 72 provided on the rotation shaft 71, and a case section 73 for housing the impeller 72 and attached to the base section 67. Furthermore, an inlet port 73*a* is provided in the case section 73.

Figure 4:
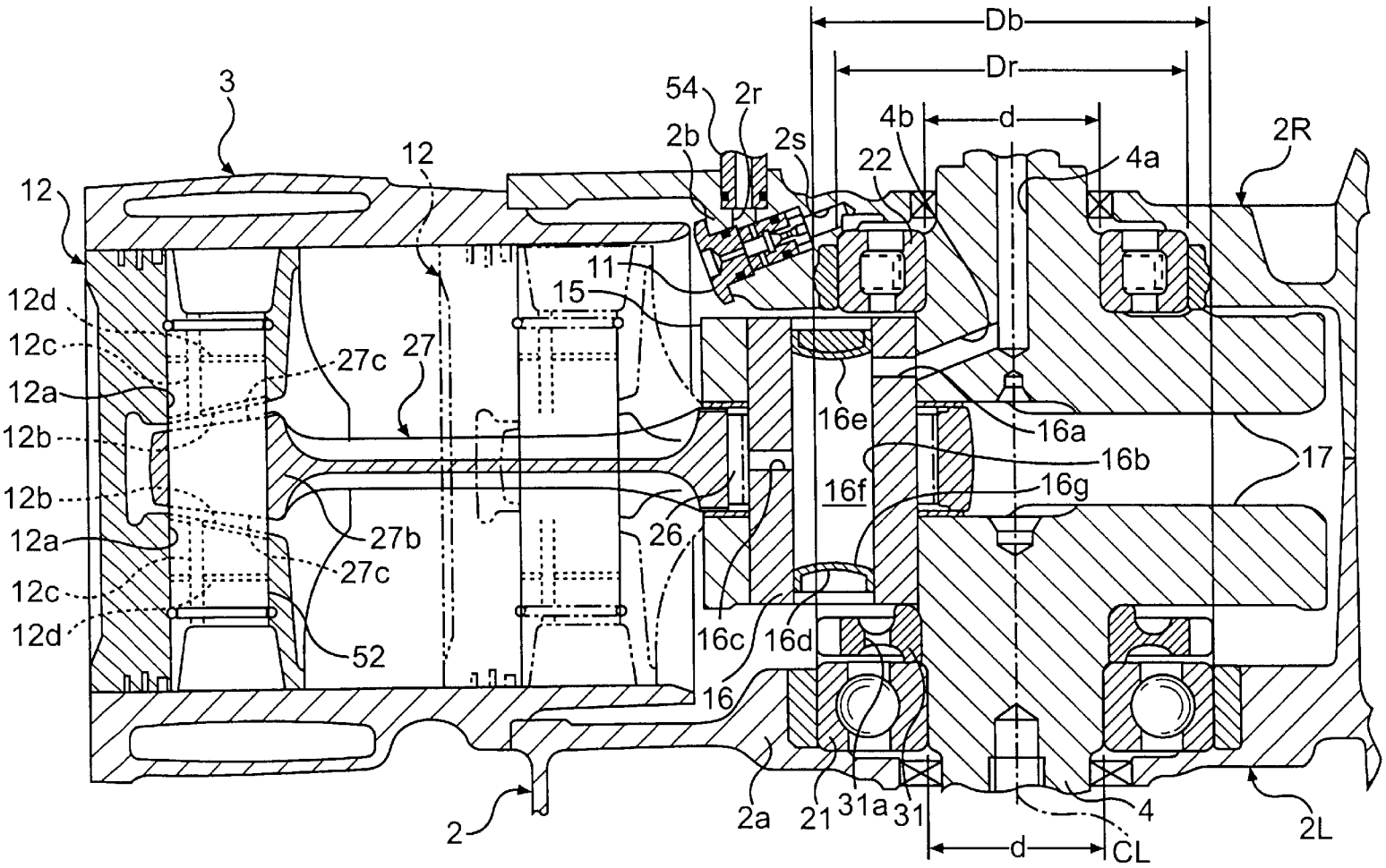
FIG. 4 is a cross sectional view showing essential parts of the crankshaft rotation structure for a four cycle engine of the present invention.

FIG. 4 is a cross sectional view showing essential parts of the crankshaft rotation structure for the four cycle engine of the present invention. A main oil passage 2*r* for supplying oil to an oil nozzle 11 and a secondary oil passage 2*s* branching off from the main oil passage 2*r* and leading to the radial roller bearing 22 are provided in the main bearing section 2*b* of the crankcase 2R. A first oil passage 4*a* and a second oil passage 4*b* connected to the first oil passage 4*a* are formed in the crankshaft 4. A first lateral oil passage 16*a* communicating with the second oil passage 4*b* of the crankshaft 4, a hollow section 16*b* and a second lateral oil passage 16*c* are formed in the crank pin 16. The end of the second lateral oil passage 16c is made to face the bearing 26, and plugs 16*d* and 16*e* are fitted on either side of the hollow section 16*b* to form an oil chamber 16*f* inside the pin. Injection holes 16*g*, 16*g* are provided in the two plugs 16*d* and 16*e*, and a through hole 31*a* is provided in the balancer shaft drive gear 31, with the injection holes 16*g* opening at positions where they face towards the through hole 31*a*.

FIG. 4 shows end surfaces 27*c*, 27*c* of the small end 27*b* of the connecting rod 27 formed having a tapered shape. Inner end surfaces 12*b*, 12*b* of the inside of pin holes 12*a*, 12*a* of the piston 12 are substantially in line with the shape of the end surfaces 27*b*, 27*b* of the small end 27*b*, and gaps are provided between the inner end surfaces 12*b*, 12*b* and the end surfaces 27*c*, 27*c*. Vertical grooves 12*c* and peripheral grooves 12*d* are respectively formed in inner peripheral surfaces of the pin holes 12*a*, 12*a*. Reference numeral CL represents an axial center (axis of rotation) of the crankshaft 4. The drawing shows the piston 12 positioned at bottom dead center.

The oil jet nozzle 11 is inserted into an attachment hole opening that is formed from the cylinder block 3 side to the second main bearing section 2*b* of the crankcase 2R. After the oil jet nozzle has been inserted, it can be prevented from falling out using a skirt lower end of the cylinder block 3 by attaching the cylinder block 3 into the crankcase section 2.

Accordingly, it is possible to improve the ease of maintenance and assembly compared to when the oil jet nozzle 11 is force fitted or held with screws.

The oil jet nozzle 11 is comprised of an upper main body and a lower cover member screwed to the main body, with the cover member having an orifice. An amount of oil supplied to the secondary oil passage 2*s* side is regulated by this orifice, effectively regulating the oil supply ratio of the oil amount to be injected to the amount of oil supplied to the secondary oil passage.

With the oil jet nozzle 11 having such a construction, it is easy to regulate the above mentioned oil supply ratio by replacing the cover member to change the orifice.

The radial ball bearing 21 has an inner diameter of d and an outer diameter of Db.

The radial roller bearing 22 has an inner diameter of d, the same as that of the radial ball bearing 21, and an outer diameter of Dr.

Generally, with a radial roller bearing, the roller makes line contact with inner and outer races, which means that compared to a main bearing where there is point contact between the ball and inner and outer races, the load bearing capacity can be set many times larger. Accordingly, when the load bearing capacity is set the same, the dimensions of the inner and outer races of the radial roller bearing can be decreased.

In the present embodiment, the inner diameter of the radial ball bearing 21 is the same as the inner diameter of the radial roller bearing 22, while the outer diameter Db of the radial ball bearing 21 and the outer diameter Dr of-the radial roller bearing satisfy the following relationship.

$$Db > Dr$$

Namely, the outer diameter of the radial roller bearing 21 can be decreased even if it has the same inner diameter as the radial ball bearing 21.

Moreover, in this embodiment, since one of the main bearings is left as a radial ball bearing 21 there is no need for additional bearings for regulating the position in the trust direction as is the case when both bearings are radial roller bearings. Therefore, even with the oil jet nozzle 11 attached to the second main bearing section 2*b* it is possible to reduce a distance from the axial center CL of the crankshaft 4 to the attachment position of the oil jet nozzle 11.

As a result, it is possible to shorten the overall length of the connecting rod 27 by lowering the bottom dead center position of the piston 12, the overall height of the cylinder block 3 can be reduced, and the engine 1 (refer to FIG. 1) can be reduced in size.

Furthermore, the radial roller bearing 22 can be decreased in width compared to the radial ball bearing 21 (the dimension in the longitudinal direction of the crankshaft 4) and the overall width of the engine 1 can be reduced.

Operation of the crankshaft rotation structure for the four cycle engine described above will now be described.

Figure 5:
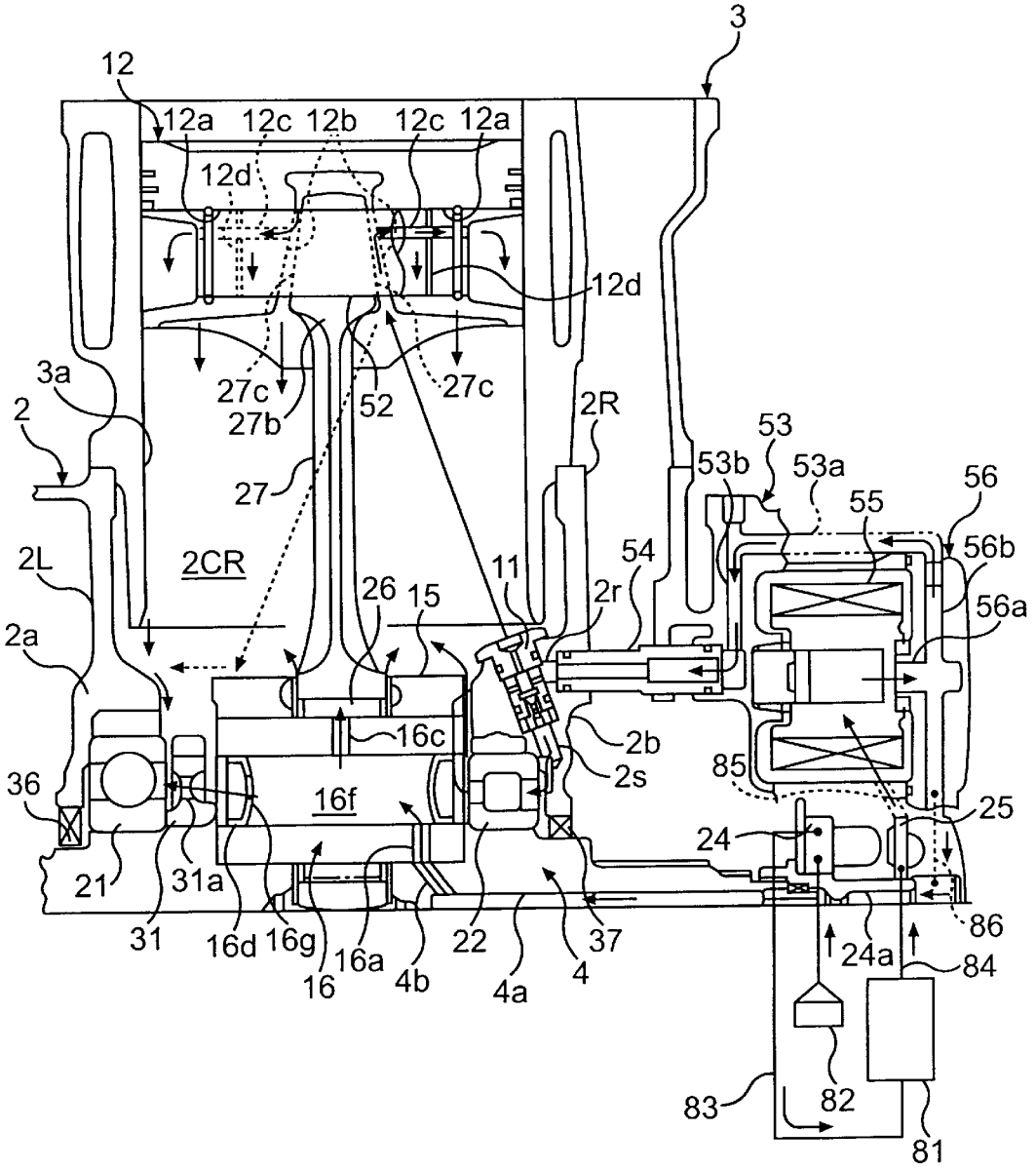
FIG. 5 is an operational drawing for explaining the operation of the crankshaft rotation structure for a four cycle engine of the present invention.

FIG. 5 is an operational drawing for explaining operation of the crankshaft rotation structure of the present invention. In order to simplify the description, the drawing is depicted with the cylinder block 3 maintained upright.

In the drawing, reference numeral 24*a* is an oil passage formed inside first and second oil pumps 24 and 25, reference numerals 53*a* and 53*b* are oil passages formed in a case side cover 53, reference numerals 56*a* and 56*b* are oil passages formed in an oil filter cover 56, reference numeral 81 is an oil filter, reference numeral 82 is an oil strainer, reference numeral 83 is an oil passage connecting the first pump 24 and the oil tank 81, reference numeral 84 is an oil passage connecting the oil tank 81 and the second oil pump 25, reference numeral 85 is an oil passage connecting the second oil pump 25 and an oil filter 55, and reference numeral 86 is an oil passage connecting an oil passage 56*b* of the oil filter cover 56 and an oil passage 24*a*.

Dry sump lubrication which is performed for essential parts of the engine will now be described below.

First of all, oil that has accumulated inside the oil tank 81 is taken in by the second oil pump 25 through the oil passage 84, passes from the second oil pump 25 through the oil filter 55 by way of the oil passage 85, and is conveyed-from the oil filter 55 to the inside of a connecting pipe 54 through the oil passage 56*a*, the oil passage 56*b*, the oil passage 53*a* and the oil passage 53*b*. The oil is then conveyed from inside the connecting pipe 54 to the main oil passage 2*r* of the main bearing section 2*b*, and supplied from this main bearing section 2*b* to the oil jet nozzle 11.

Oil that has been supplied to the oil jet nozzle 11 is injected from the tip of the oil jet nozzle 11 to the inner side of the piston 12.

During lowering of the piston 12 from top dead center, oil that has been injected from the oil jet nozzle 11 enters into the vertical groove 12*c* and the peripheral groove 12*d* of the pin hole 12*a* further to the right in the drawing than the small end 27*b*, from a gap between the end surface 27*c* of the small end 27*b* of the connecting rod 27 and the inner surface 12*b* of the piston 12, to lubricate sliding surfaces of the pin hole 12*a* and the piston pin 52.

Oil that has entered into the gap between the end surface 27*c* of the connecting rod 27 and the inner surface 12*b* of the piston 12 passes through an upper part of the small end 27*b* of the connecting rod 27, reaches a gap between the end surface of the connecting rod 27 and an inner surface 12*b* of the piston 12, is and enters into the vertical groove 12*c* and the peripheral groove 12*d* of the pin hole 12*a* further to the left in the drawing than the small end 27*b*, to lubricate sliding surfaces of the pin hole 12*a* and the piston pin 52.

In this way, since the small end 27*b* of the connecting rod 27 is supplied with oil from the oil jet nozzle 11 and is formed in a substantially horizontally tapered shape, the small end 27*b* is extremely well lubricated.

Oil that has lubricated the inside of the pin holes 12*a*, 12*a* reaches the first and second main bearing sections 2*a* and 2*b* and the crank section 15 by dripping and going along the cylinder section 3*a*. Also, while dripping, some oil collides with a counter weight of the rotating crankshaft 4, thereby forming an oil mist.

Some of the oil that is injected from the oil jet nozzle 11 and has reached the gap between the end surface 27*c* of the connecting rod 27 and the inner end surface 12*b* of the piston 12 splashes to the edge of the crank section 15, as shown by the dotted line, by rebounding at the lower part of the piston 12 and the piston pin 52, and lubricates meshing portions of the balancer shaft drive gear 31 and the driven gear 65 (refer to FIG. 3), and the radial ball bearing 21.

Oil that has branched off from the main oil passage 2*r* of the second main bearing section 2*b* to the secondary oil passage 2*s* reaches the radial roller bearing 22 to thus lubricate the radial roller bearing 22.

The oil then passes from the radial roller bearing 22 through a gap between the second main bearing section 2*b* and the crank section 15, and splashes inside the crank chamber 2CR.

Oil that has been conveyed from the oil filter 55 to the oil passage 56*a* and the oil passage 56*b* passes through the oil passage 86 and the oil passage 24*a*, through the first oil passage 41 and the second oil passage 4*b* inside the crankshaft 4, through the first lateral oil passage 16*a*, oil chamber 16*f* and the second lateral oil passage 16*c* inside the crank pin 16 to reach the bearing 26 of the connecting rod 27 to lubricate the bearing 26, and then flows from a gap between the crank section 15 and the connecting rod 27 into the crank chamber 2CR.

Oil in the pin oil chamber 16f of the crank pin 16 is further injected from an injection hole 16*g* of a plug 16*d*, passes through a through hole 31*a* of the balancer shaft drive gear 31 to reach the radial ball bearing 21 and thus lubricate the radial ball bearing 21.

With the above described arrangement, oil that has lubricated each of the engine parts is drawn from an oil strainer 82 provided inside an oil sump (not shown in the drawing) of a lower part of the crankcase section 2 by the first oil pump 24, through the oil passage 83 and into the oil tank 81.

In the present embodiment, the radial ball bearing 21 has been provided in the first main bearing section 2*a*, but this is in no way limiting, and it is also possible to provide a radial roller bearing in the first main bearing section 2*a* and to provided a radial ball bearing in the second main bearing section 2*b*.

By virtue of the above described construction, the present invention achieved the following effects.

The crankshaft rotation structure for a four cycle engine of claim one has a radial ball bearing fitted into a first main bearing section, a radial roller bearing fitted into a second main bearing section of the crankcase, a crankshaft rotatably supported by the radial ball bearing and radial roller bearing, and an oil jet nozzle provided in the second main bearing section, which means that the diameter of the shafts for attachment of the bearings are the same even though the outer diameter of the radial roller shaft can be decreased when compared to the outer diameter of the radial ball bearing.

Accordingly, even if the oil jet nozzle is provided in the second main bearing section into which the radial roller bearing is fitted, the distance from the crankshaft center to the attachment position of the oil jet can be decreased and the engine itself can be reduced in size.

The crankshaft rotation structure for a four cycle engine of the present invention also has a main oil passage and a secondary oil passage provided in the second main bearing section which means that oil can be supplied from the secondary oil passage to the radial roller bearing, the durability of the radial roller bearing can be improved and the lifespan can be prolonged.

The invention being thus described, it will be obvious that the same may be varied in many ways. Such variations are not to be regarded as a departure from the spirit and scope of the invention, and all such modifications as would be obvious to one killed in the art are intended to be included within the scope of the following claims.

We claim:

1. A crankshaft rotation structure for a four cycle engine comprising:

a radial ball bearing for being fitted into a first main bearing section of a crankcase;

a radial roller bearing for being fitted into a second main bearing section of the crankcase;

a crankshaft rotatably supported by the radial ball bearing and the radial roller bearing;

an oil jet nozzle for cooling a piston, said oil jet nozzle mountable in the second main bearing section;

a main oil -passage for sup-plying oil to the oil jet nozzle; and a secondary oil passage branching off from the main oil passage and leading to the radial roller bearing, provided in the second main bearing section.

2. The crankshaft rotation structure for a four cycle engine according to claim 1, wherein a first oil passage and a second oil passage connected to the first oil passage are formed in the crankshaft.

3. The crankshaft rotation structure for a four cycle engine according to claim 2, further comprising:

a first lateral oil passage in communication with the second oil passage;

a crank pin; and a hollow section and a second lateral oil passage formed in the crank pin.

4. The crankshaft rotation structure for a four cycle engine according to claim 3, wherein plugs are fitted on opposite sides of the hollow section forming an oil chamber inside the crank pin, and injection holes are provided in the plugs.

5. The crankshaft rotation structure for a four cycle engine according to claim 1, wherein the oil jet nozzle includes an upper main body and a lower cover member attached to the main body, said cover member having an orifice formed therein, said orifice regulating an amount of oil supplied to the secondary oil passage.

6. A crankshaft rotation structure for a four cycle engine comprising:

a radial ball bearing for being fitted into a first main bearing section of a crankcase;

a radial roller bearing for being fitted into a second main bearing section of the crankcase;

a crankshaft rotatable supported by the radial ball bearing and the radial roller bearing;

an oil jet nozzle for cooling a piston, said oil jet nozzle mountable in the second main bearing section; and wherein the inner diameters of the radial ball bearing and the radial roller bearing are the same and the outer diameter of the radial ball bearing is larger than the outer diameter of the radial roller bearing.

7. A four-cycle engine having a crankshaft rotation structure comprising:

a crankcase having first and second main bearing sections;

a radial ball bearing fitted into the first main bearing section of the crankcase;

a radial roller bearing fitted into the second main bearing section of the crankcase;

a crankshaft rotatably supported by the radial ball bearing and the radial roller bearing;

an oil jet nozzle for cooling a piston provided in the second main bearing section; and wherein the inner diameters of the radial ball bearing and the radial roller bearing are the same and the outer diameter of the radial ball bearing is larger than the outer diameter of the radial roller bearing.

8. The four-cycle engine having a crankshaft rotation structure according to claim 7, further comprising:

a main oil passage for supplying oil to the oil jet nozzle; and a secondary oil passage branching off from the main oil passage and leading to the radial roller bearing, provided in the second main bearing section.

9. The four-cycle engine having a crankshaft rotation structure according to claim 8, wherein a first oil passage and a second oil passage connected to the first oil passage are formed in the crankshaft.

10. The four-cycle engine having a crankshaft rotation structure according to claim 9, further comprising:

a first lateral oil passage in communication with the second oil passage;

a crank pin; and a hollow section and a second lateral oil passage formed in the crank pin.

11. The four-cycle engine having a crankshaft rotation structure according to claim 10, wherein plugs are fitted on opposite sides of the hollow section forming an oil chamber inside the crank pin, and injection holes are provided in the plugs.

12. The four-cycle engine having a crankshaft rotation structure according to claim 8, wherein the oil jet nozzle includes an upper main body and a lower cover member attached to the main body, said cover member having an orifice formed therein, said orifice regulating an amount of oil supplied to the secondary oil passage.

* * * * *